US011280325B1

(12) United States Patent
Polyakov

(10) Patent No.: US 11,280,325 B1
(45) Date of Patent: Mar. 22, 2022

(54) HALL-EFFECT THRUSTER WITH AN ACCELERATING CHANNEL ACTING AS A MAGNETIC SHIELD

(71) Applicant: PIPL LIMITED, Nicosia (CY)

(72) Inventor: Maxym Polyakov, Nicosia (CY)

(73) Assignee: PIPL LIMITED, Nicosia (CY)

( * ) Notice: Subject to any disclaimer, the term of this patent is extended or adjusted under 35 U.S.C. 154(b) by 0 days.

(21) Appl. No.: 17/494,945

(22) Filed: Oct. 6, 2021

(51) Int. Cl.
*F03H 1/00* (2006.01)

(52) U.S. Cl.
CPC ..... *F03H 1/0075* (2013.01); *F03H 1/0062* (2013.01); *F03H 1/0068* (2013.01)

(58) Field of Classification Search
CPC ..... F03H 1/0062–0075
See application file for complete search history.

(56) References Cited

U.S. PATENT DOCUMENTS

2006/0186837 A1* 8/2006 Hruby ..... F03H 1/0075 315/501
2017/0159648 A1* 6/2017 Karadag ..... F03H 1/0012
2020/0256325 A1* 8/2020 Kronhaus ..... F03H 1/0018

OTHER PUBLICATIONS

Fully Kinetic Modeling of Low-Power Hall Thrusters, IEPC-2005-035, Presented at the 29th International Electric Propulsion Conference, Princeton University, Oct. 31-Nov. 4, 2005, Sergey V. Irishkov*, Oleg A. Gorshkov†, Andrey A. Shagayda‡, Keldysh Research Center, Moscow, Russia.
Review of Hall Thruster Neutral Flow Dynamics, IEPC-2007-038, Presented at the 30th International Electric Propulsion Conference, Florence, Italy, Sep. 17-20, 2007, Bryan M. Reid* and Alec D. Gallimore†, University of Michigan, Ann Arbor, MI 48105, USA.

* cited by examiner

*Primary Examiner* — Raul J Rios Russo
(74) *Attorney, Agent, or Firm* — Georgiy L. Khayet

(57) ABSTRACT

Methods and systems for electric propulsion are provided. An example method includes providing a magnetic shield using an accelerating channel made of a soft magnetic material; generating, by a magnetic system, a radial magnetic field in the accelerating channel to ionize a working substance, wherein the magnetic system includes a central magnetic pole, an outer annular pole, a magnetic circuit, and coils to carry an electrical current; and generating, using an outer hollow cathode and an anode-gas distributor disposed within the accelerating channel, an electrical discharge along the accelerating channel. The accelerating channel provides the magnetic shield to force the radial magnetic field to have a maximum gradient at a location of the central magnetic pole and at a location of the outer annular pole and to force ions of a working substance to pass isolators of magnetic poles, thereby decreasing erosion of the isolators.

20 Claims, 7 Drawing Sheets

600

HALL-EFFECT THRUSTER WITH AN ACCELERATING CHANNEL ACTING AS A MAGNETIC SHIELD

TECHNICAL FIELD

This disclosure generally relates to rocket and space technology. More specifically, this disclosure relates to Hall-effect thrusters (HETs) with an accelerating channel acting as a magnetic shield.

BACKGROUND

Electric propulsion systems are typically used for stabilizing and changing orientation and orbit of space vehicles and satellites. The electric propulsion systems may include HETs. The HETs ionize working substance and accelerate the resulting ions to produce propulsion. However, the ions may cause degradation of parts of HETs, thereby leading to loss of efficiency of the HETs during long operations.

SUMMARY

This section introduces a selection of concepts in a simplified form that are further described in the Detailed Description section, below. This summary does not identify key or essential features of the claimed subject matter and is not intended to be an aid in determining the scope of the claimed subject matter.

This disclosure generally relates to electric propulsion systems. More specifically, the present technology provides HETs with accelerating channel acting as a magnetic shield.

According to one embodiment of this disclosure, an HET may include an accelerating channel made of a soft magnetic material to provide a magnetic shield. The HETs may include a magnetic system. The magnetic system may include a central magnetic pole, an outer annular pole, a magnetic circuit, and coils to carry an electrical current. The magnetic system may generate a radial magnetic field in the accelerating channel for ionizing a working substance. The HET may include an anode-gas distributor disposed within the accelerating channel and an outer hollow cathode. The anode-gas distributor and the outer hollow cathode may generate an electrical discharge along the accelerating channel.

The accelerating channel can be made of a metallic material and provide the magnetic shield for decreasing the radial magnetic field along the accelerating channel.

The accelerating channel may provide the magnetic shield forcing the radial magnetic field to have a maximum gradient at a location of the central magnetic pole and at a location of the outer annular pole.

The accelerating channel may provide the magnetic shield to force generation of ions of a working substance at a location of the central magnetic pole and at a location of the outer annular pole. The accelerating channel may provide the magnetic shield for maximizing acceleration of ions of a working substance at a location of the central magnetic pole and at a location of the outer annular pole.

The HET may include a first isolator to protect the central magnetic pole and a second isolator to protect the outer annular pole. The accelerating channel may provide the magnetic shield to force ions of a working substance to pass the first isolator and the second isolator, thereby decreasing erosion of the first isolator and the second isolator.

The HET may include a xenon storage and feed system (XFS) to provide a working substance to the anode-gas distributor and an outer hollow cathode. The electric propulsion system may include a power processing unit (PPU) to provide the discharge current between anode and hollow cathode and electrical current to the magnet system coils.

Additional objects, advantages, and novel features of the examples will be set forth in part in the description which follows, and in part will become apparent to those skilled in the art upon examination of the following description and the accompanying drawings or may be learned by production or operation of the examples. The objects and advantages of the concepts may be realized and attained by means of the methodologies, instrumentalities, and combinations particularly pointed out in the appended claims.

BRIEF DESCRIPTION OF THE DRAWINGS

Embodiments are illustrated by way of example and not limitation in the figures of the accompanying drawings, in which like references indicate similar elements and in which.

DETAILED DESCRIPTION OF EXAMPLE EMBODIMENTS

Figure 1:
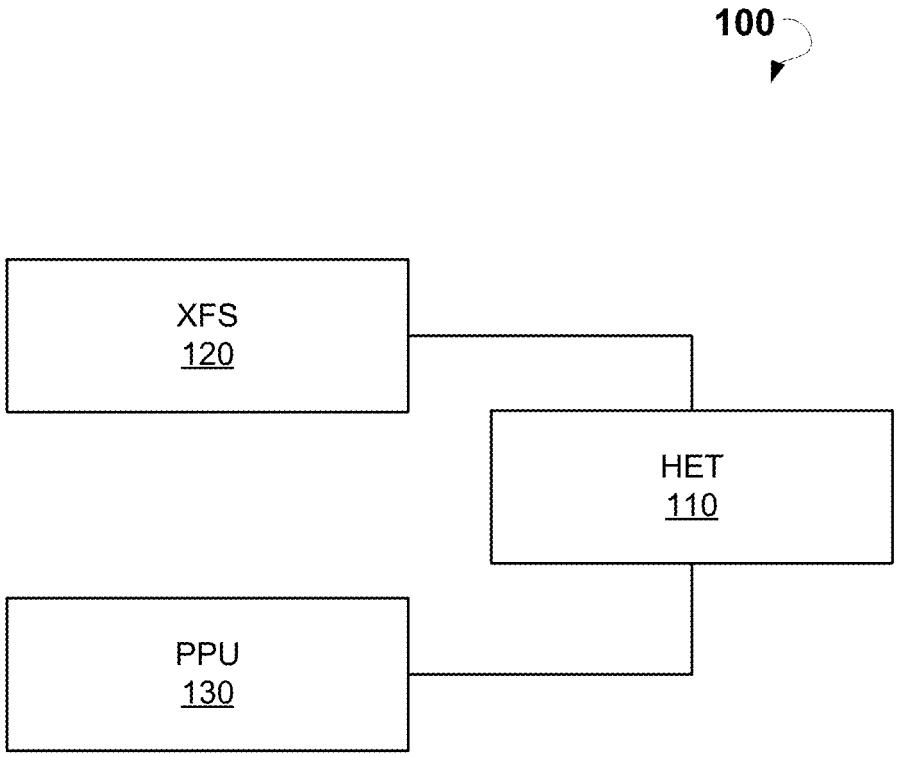
FIG. 1 is a high-level block diagram of an electric propulsion system, according to some example embodiments of the present disclosure.

The following detailed description of embodiments includes references to the accompanying drawings, which form a part of the detailed description. Approaches described in this section are not prior art to the claims and are not admitted to be prior art by inclusion in this section. The drawings show illustrations in accordance with example embodiments. The embodiments can be combined, other embodiments can be utilized, or structural, logical and operational changes can be made without departing from the scope of what is claimed. The following detailed description is, therefore, not to be taken in a limiting sense, and the scope is defined by the appended claims and their equivalents.

Embodiments of this disclosure are concerned with space and rocket technology and, more specifically, related to a design of electric propulsion systems. According to an example embodiment of the present disclosure, the electric propulsion system may include an HET. The HETs may include an accelerating channel made of a soft metallic magnetic material to provide a magnetic shield. The HET may include a magnetic system. The magnetic system may include a central magnetic pole, an outer annular pole, a magnetic circuit, and coils carrying an electrical current. The magnetic system may generate a radial magnetic field in the accelerating channel where a working substance is ionizing. The HET may include an anode-gas distributor disposed within the accelerating channel and an outer hollow cathode. The anode-gas distributor and the outer hollow cathode generate an electrical discharge along the accelerating channel. The electric propulsion system may include a XFS to provide a working substance to the anode-gas distributor and an outer hollow cathode. The electric propulsion system may include a PPU to provide the electrical current to the coil.

Referring now to the drawings, exemplary embodiments are described. The drawings are schematic illustrations of idealized example embodiments. Thus, the example embodiments discussed herein should not be construed as limited to the particular illustrations presented herein, rather these example embodiments can include deviations and differ from the illustrations presented herein.

FIG. 1 is a high-level block diagram of an electric propulsion system 100. The electric propulsion system may include an HET 110, a XFS 120, and a PPU 130. The HET 110 may develop thrust. The XFS 120 may supply a working substance to the HET. The PPU 130 may provide power to all subsystems of the electric propulsion system 100.

Traditional HETs typically include an anode-gas distributor, outer hollow cathode, dielectric accelerating channel, and magnetic system comprising a central magnetic pole, outer annular pole, magnetic circuit, and coils for carrying electric current.

Figure 2:
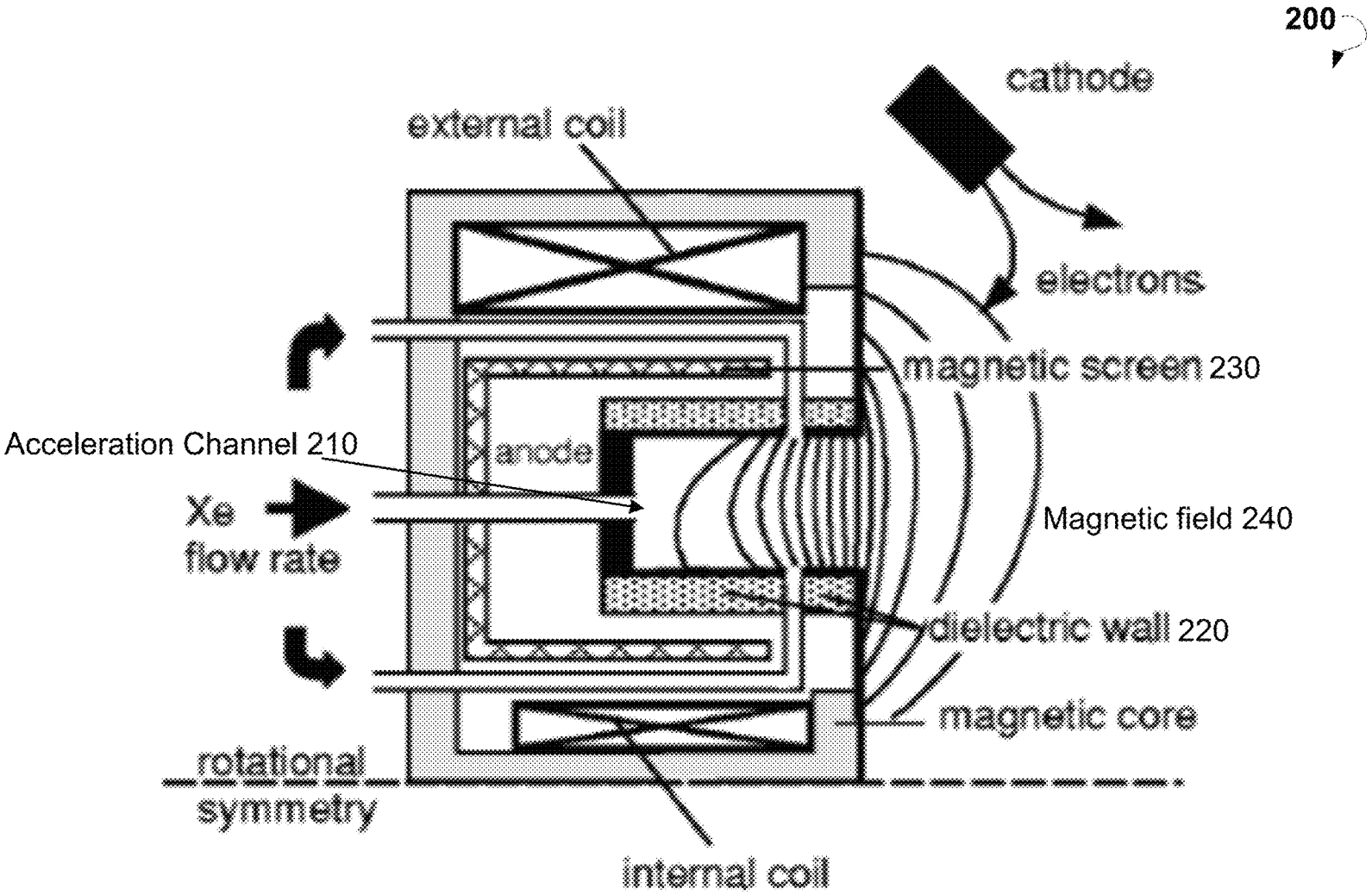
FIG. 2 is a block diagram showing a design scheme of an acceleration channel and a magnetic system of an HET.

FIG. 2 is a block diagram showing a design scheme 200 of an acceleration channel and a magnetic system of an example HET. As shown in FIG. 2, the acceleration channel 210 of the HET can be made of a dielectric wall 220 and located inside a magnetic screen 230. The use of the magnetic screen 230 in the design scheme 200 makes it possible to increase the steepness of the accretion in the induction of the magnetic field 240 in the acceleration channel 210. As a result, the ion acceleration zone in the acceleration channel 210 is reduced allowing to increase the uniformity of the ion beam and improving the traction parameters of the HET.

Figure 3:
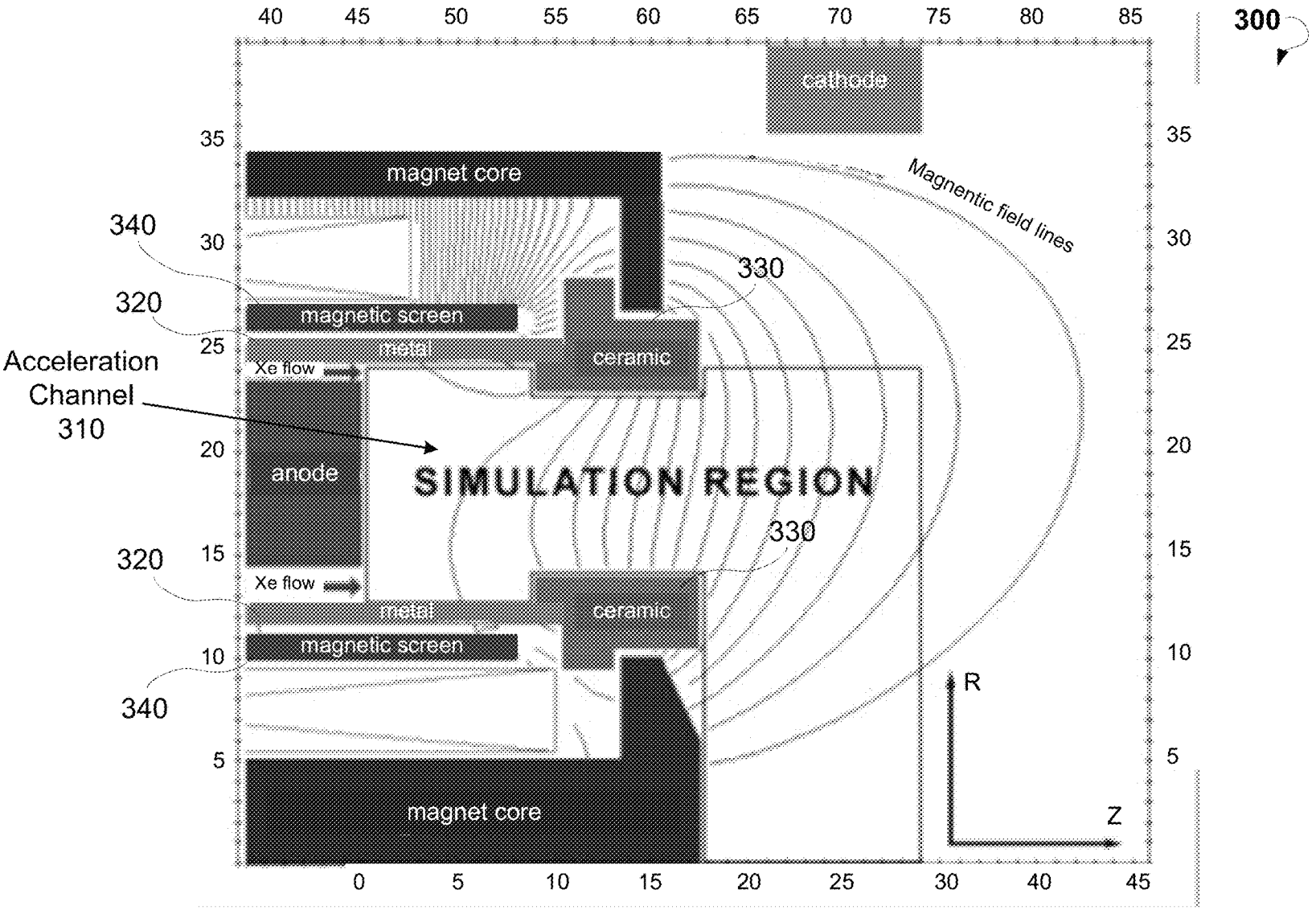
FIG. 3 is a block diagram showing a modified design scheme of an acceleration channel and a magnetic system of an HET.

FIG. 3 is a block diagram showing a modified design scheme 300 of an acceleration channel and a magnetic system of an example HET. As shown in the FIG. 3, the acceleration channel 310 of the HET is formed by a metal part 320 and a dielectric part 330 made of ceramic. The metal part 320 and the dielectric part 330 are placed inside a magnetic screen 340.

In contrast to the design scheme 200 and the modified design scheme 300, embodiments of the present disclosure are directed to HETs having an accelerating channel made of a metallic soft magnetic material. As a result, the acceleration channel can also act as a magnetic screen (also referred to as a magnetic shield). Therefore, a separate magnetic screen, such as the magnetic screen 230 in FIG. 2 or the magnetic screen 340, is not required. Thus, the design of the acceleration channel and the magnetic system of the present disclosure makes it possible to significantly simplify the design of the HET while preserving all the advantages of the design scheme 200 and the modified design scheme 300. According to embodiments of the present disclosure, the HET 110 includes an accelerating channel made of a metallic soft magnetic material enabling the accelerating channel to act as a magnetic shield.

Figure 4:
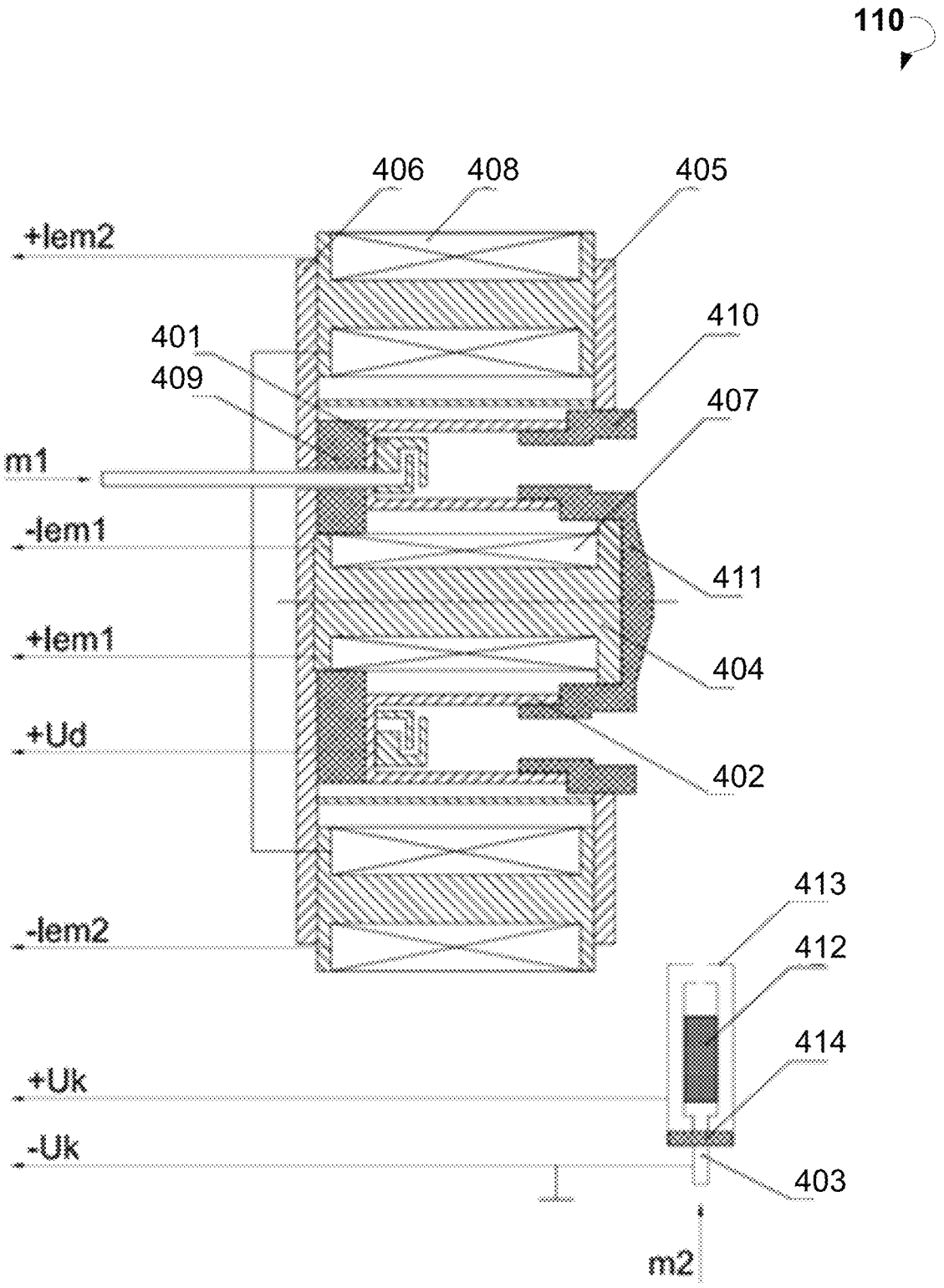
FIG. 4 is a block diagram of a HET with an accelerating channel acting as a magnetic shield, according to some example embodiments of the present disclosure.

FIG. 4 is a block diagram of a HET 110 with an accelerating channel acting as a magnetic shield, according to some example embodiments of the present disclosure. The HET 110 may include anode-gas distributor 401, accelerating channel 402, an outer hollow cathode 403, and a magnetic system including a central magnetic pole 404, an outer annular magnetic pole 405, a magnetic circuit 406, a central coil 407, and outer coils 408. The HET 110 may also include an insulator 409, an insulator 410, and an insulator 411.

The anode-gas distributor 401 can be located in the accelerating channel 402. The anode-gas distributor 401 together with the outer hollow cathode 403 may provide an electric discharge in the accelerating channel 402. The magnetic system of the thruster may create a radial magnetic field in the accelerating channel 402. The insulator 409 may provide galvanic isolation of the accelerating channel 402 from magnetic circuit 406. The magnetic circuit 406 can be in a housing of the HET 110. The accelerating channel 402 may be under the plasma potential of the anode-gas distributor 401. Insulators 410 and 411 may isolate a part of the accelerating channel 402 from the plasma potential and prevent erosion of the magnetic poles 404 and 405 during ion acceleration.

According to embodiments of the present disclosure, the HET 110 utilize an outer self-heated hollow cathode 403. The outer self-heated hollow cathode 403 may include an ampoule 412 with emitter material, a keeper 413, and an insulator 414. The keeper 413 may provide an internal discharge and preheating of the outer self-heated hollow cathode 403. The insulator 414 may provide galvanic isolation of the keeper potential from the hollow cathode potential.

The XFS 120 may supply amount m1 of the working substance (xenon) to the anode-gas distributor 401 and amount m2 of the working substance to the outer self-heated hollow cathode 403. In the FIG. 4, Ud denotes a voltage of the discharge power source, Iem1 denotes a current of the central coil 407 of the magnetic system, Iem2 denotes a current of the outer coils 408 of the magnetic system, and Uk denotes a keeper voltage of the outer self-heated hollow cathode 403.

When the voltages and currents are provided to the HET 110 and the amount m1 of the working substance is provided to the anode-gas distributor 401 and the amount m2 of the working substance is provided to the outer self-heated hollow cathode 403, an arc discharge can be formed in the accelerating channel 402. The arc discharge may occur in the presence of a radial magnetic field formed by the magnetic system of the HET and an axial electric field generated by the outer self-heated hollow cathode 403 and an anode-gas distributor 401. The ions formed in the accelerating channel as a result of the arc discharge are accelerated by an axial electric field, resulting in the reactive thrust force of the HET 110.

The accelerating channel 402 can be made of a metallic soft magnetic material. In a preferred embodiment, the metallic soft magnetic material used for manufacturing the accelerating channel 402 may have the following magnetic properties: the value of magnetic saturation is not less than 1.8-2.0 Tesla, the value of the coercive force is 50-80 Ampere per meter, and the Curie point is 800-900° Celsius. The Curie point 800-900° Celsius substantially exceeds the operating temperature of the accelerating channel, which is 300-400° Celsius. In some embodiments, one of the following metallic soft magnetic materials can be used for manufacturing the accelerating channel 402: Permendur 49 (USA), Telar 57 "ARMCO" (USA), and 1.1014 (RFe80) DIN 17405.

Figure 5:
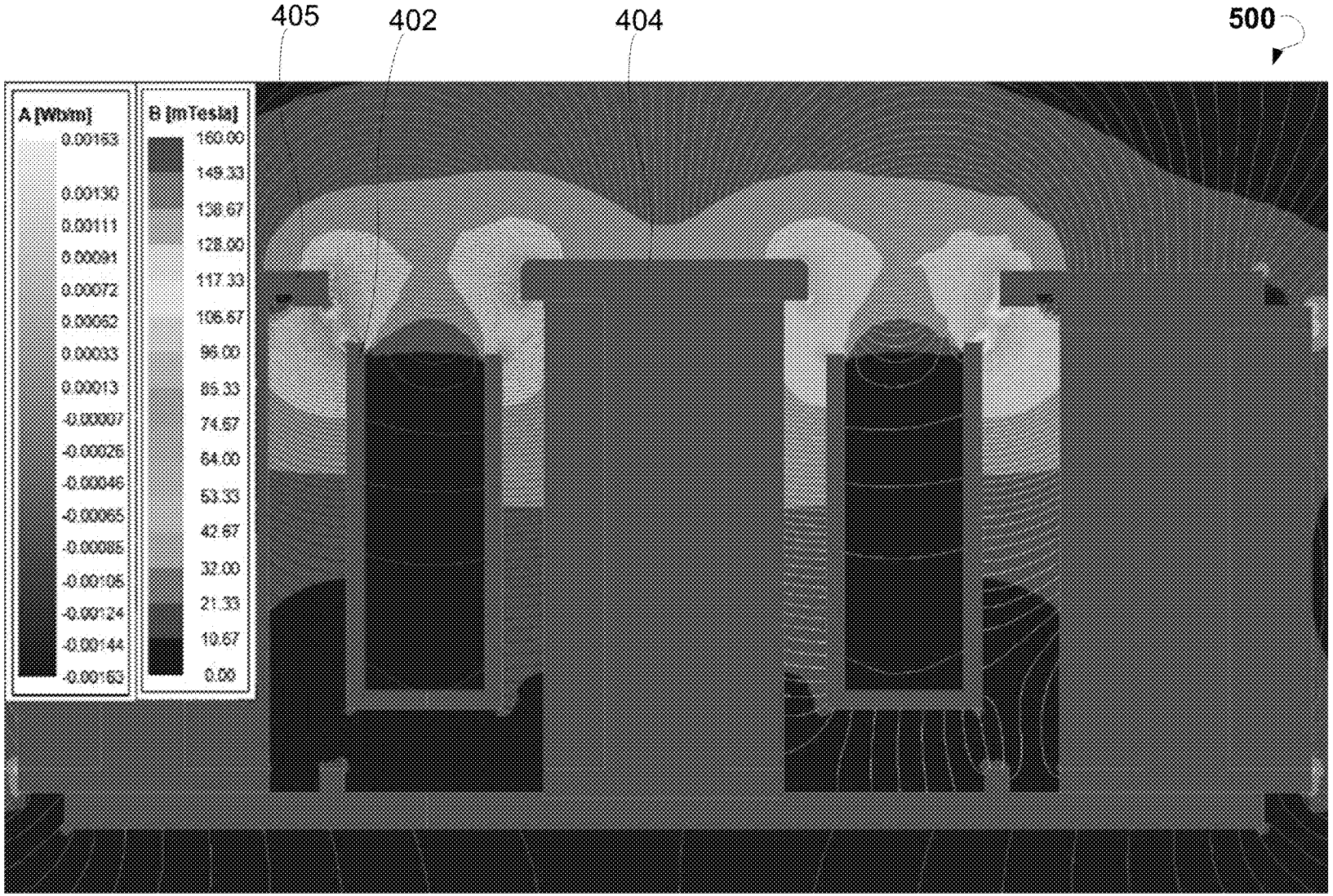
FIG. 5 is a plot of a magnetic field distribution in the cross section of the HET, according to an example embodiment of the present disclosure.

FIG. 5 is a plot of a distribution of a magnetic field 500 in a cross section of the HET 110, according to an example embodiment of the present disclosure. The shape of configuration of the magnetic field 500 in the acceleration channel 402 and in the locations of the magnetic poles 404 and 405 is a result of the usage of accelerating channel 402 (made of a metallic soft magnetic material) as a magnetic shield. Specifically, as shown in FIG. 5, the magnetic field 500 along the entire length of the acceleration channel 402 is relatively small (about 10-20 milli Tesla). The maximum gradient of the magnetic field 500 occurs in the locations of the magnetic poles 404 and 405, where the main part of the ionization of the working substance and the acceleration of the formed ions by a significant electric field take place.

Figure 6:
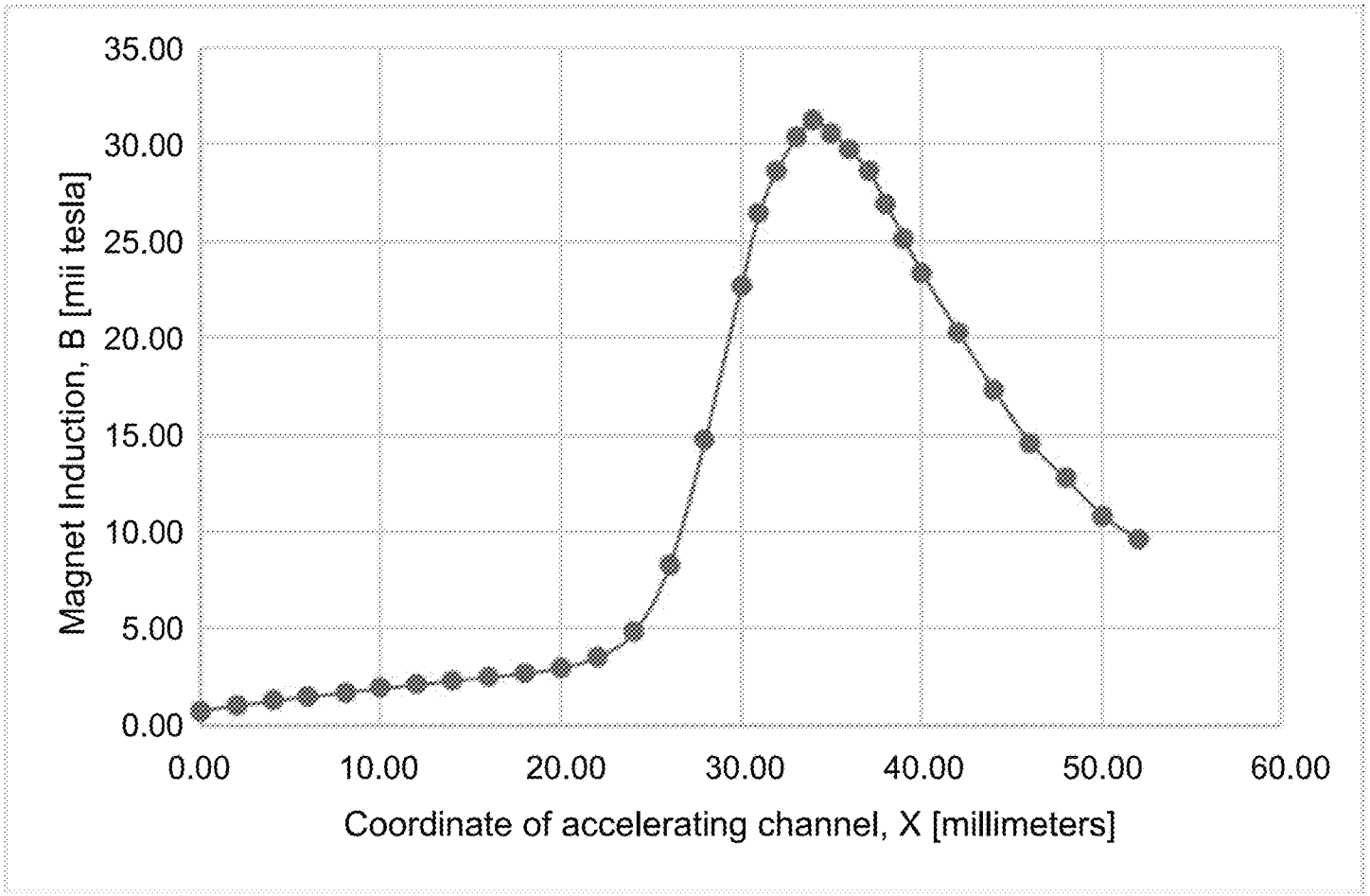
FIG. 6 is a plot of distribution of the magnetic field induction along the accelerating channel of HET, according to an example embodiment of the present disclosure.

FIG. 6 is a plot of distribution of the magnetic field induction 600 along the accelerating channel of HET 110, according to an example embodiment of the present disclosure. As a result of the usage of an acceleration channel acting as a magnetic shield, the ionization zone of the working substance and acceleration of the formed ions is located almost on the face of the HET 110 in the area of the magnetic poles 404 and 405. This provides several advantages of the proposed HET design compared to traditional designs of the HETs:

1) An increase of the magnetic field gradient in the acceleration channel of the HET leads to the formation of a short acceleration zone of the formed ions. The short acceleration zone of the formed ions results in the increase of uniformity of the distribution of ion velocities in an ion beam. The uniformity of the distribution of the ion velocities in the ion beam leads to an increase in the efficiency of the thruster.

2) The process of ion acceleration in the short acceleration zone leads to the fact that the ions, whose trajectories are directed at an angle with respect to the longitudinal axis of the acceleration channel 402, move past the insulators 410 and 411 located in the locations of the magnetic poles 404 and 405. This fact leads to a significant reduction in the erosion of the insulators 410 and 411 as compared to traditional HETs.

The proposed design of the HET with an acceleration channel acting as a magnetic shield was implemented by an inventor in the HET ST-40. Laboratory tests of the ST-40 thruster confirmed the correctness of the proposed technical solution and the advantages of the proposed design in comparison with traditional HETs.

The magnitude of the magnetic field created by the magnetic system of the HET significantly affects the processes of ionization of the working substance in the accelerating channel, acceleration of ions in the accelerating channel, and focusing of the ion beam. Therefore, the usage of a soft magnetic material for the walls of the accelerating channel 402 can make it necessary to correct the magnitude of the magnetic field. The condition for correcting the magnitude of the magnetic field can include minimizing the discharge current in the accelerating channel 402 while maintaining the magnitude of the thrust of HET 110 and minimizing the breakup of the ion beam (that is, increasing the integral level of the thrust).

Figure 7:
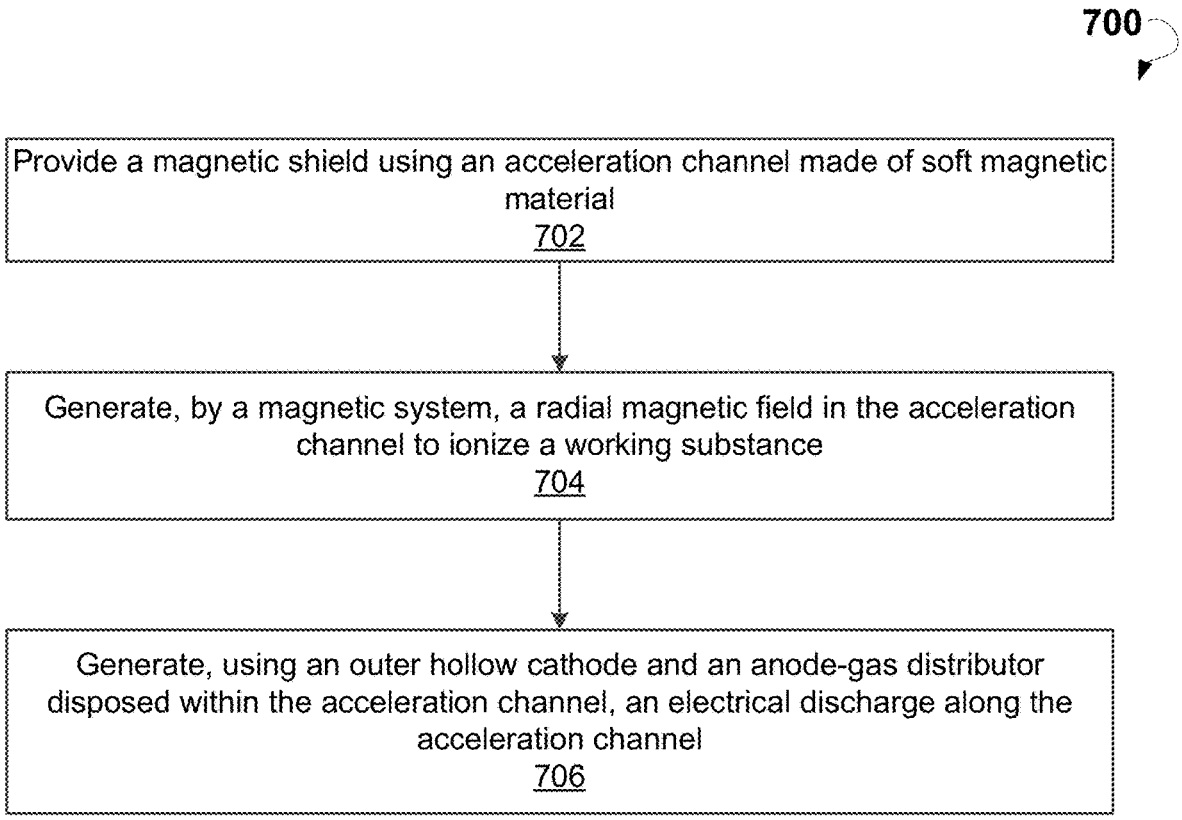
FIG. 7 is a flow chart showing a method for electric propulsion, according to an example embodiment.

FIG. 7 is a flow chart showing a method 700 for electric propulsion, according to an example embodiment. The method 700 may commence in block 702 with providing a magnetic shield using an accelerating channel made of a soft magnetic material. The accelerating channel can be made of a metallic material.

In block 704, the method 700 may include generating, by a magnetic system, a radial magnetic field in the accelerating channel to ionize a working substance. The magnetic system may include a central magnetic pole, an outer annular pole, a magnetic circuit, and coils to carry an electrical current. The accelerating channel may provide the magnetic shield to decrease the radial magnetic field in a portion of the accelerating channel. The accelerating channel may provide the magnetic shield to force the radial magnetic field to have a maximum gradient at a location of the central magnetic pole and at a location of the outer annular pole.

The accelerating channel may provide the magnetic shield to force generation of ions of a working substance at a location of the central magnetic pole and at a location of the outer annular pole.

In block 706, the method 700 may include generating, using an outer hollow cathode and an anode-gas distributor disposed within the accelerating channel, an electrical discharge along the accelerating channel.

The method 700 may include protecting, by a first isolator, the central magnetic pole and protecting, by a second isolator, the outer annular pole. The accelerating channel may provide the magnetic shield to force ions of a working substance to pass the first isolator and the second isolator, and, thereby, decrease erosion of the first isolator and the second isolator.

The method 700 may include providing, by a XFS, a working substance to the anode-gas distributor and an outer hollow cathode. The method 700 may include providing, by a power processing unit, the electrical current to the coil.

Thus, an HET based electric propulsion system with an accelerating channel acting as a magnetic shield have been described. Although embodiments have been described with reference to specific example embodiments, it will be evident that various modifications and changes can be made to these example embodiments without departing from the broader spirit and scope of the present document. Accordingly, the specification and drawings are to be regarded in an illustrative rather than a restrictive sense.

What is claimed is:

1. A Hall-effect thruster (HET) comprising:

an accelerating channel made of a soft magnetic material to provide a magnetic shield;

a magnetic system including a central magnetic pole, an outer annular pole, a magnetic circuit, and coils to carry an electrical current, wherein the magnetic system is to generate a radial magnetic field in the accelerating channel for ionizing a working substance;

an anode-gas distributor disposed within the accelerating channel; and an outer hollow cathode, the anode-gas distributor and the outer hollow cathode to generate an electrical discharge along the accelerating channel.

2. The HET of claim 1, wherein the accelerating channel is made of a metallic material.

3. The HET of claim 1, wherein the accelerating channel is to provide the magnetic shield for decreasing the radial magnetic field along a part of the accelerating channel.

4. The HET of claim 1, wherein the accelerating channel is to provide the magnetic shield forcing the radial magnetic field to have a maximum gradient at a location of the central magnetic pole and at a location of the outer annular pole.

5. The HET of claim 1, wherein the accelerating channel is to provide the magnetic shield to force generation of ions of a working substance at a location of the central magnetic pole and at a location of the outer annular pole.

6. The HET of claim 1, wherein the accelerating channel provides the magnetic shield for maximizing acceleration of ions of a working substance at a location of the central magnetic pole and at a location of the outer annular pole.

7. The HET of claim 1, further comprising a first isolator to protect the central magnetic pole and a second isolator to protect the outer annular pole.

8. The HET of claim 7, wherein the accelerating channel provides the magnetic shield to force ions of a working substance to pass the first isolator and the second isolator, thereby decreasing erosion of the first isolator and the second isolator.

9. The HET of claim 1, further comprising a xenon storage and a feed system to provide a working substance to the anode-gas distributor and an outer hollow cathode.

10. The HET of claim 1, further comprising a power processing unit to provide the electrical current to the coil.

11. A method for electric propulsion, the method comprising:

providing a magnetic shield using an accelerating channel made of a soft magnetic material;

generating, by a magnetic system, a radial magnetic field in the accelerating channel to ionize a working substance, wherein the magnetic system includes a central magnetic pole, an outer annular pole, a magnetic circuit, and coils to carry an electrical current; and generating, using an outer hollow cathode and an anode-gas distributor disposed within the accelerating channel, an electrical discharge along the accelerating channel.

12. The method of claim 11, wherein the accelerating channel is made of a metallic material.

13. The method of claim 11, wherein the accelerating channel provides the magnetic shield to decrease the radial magnetic field in a portion of the accelerating channel.

14. The method of claim 11, wherein the accelerating channel provides the magnetic shield to force the radial magnetic field to have a maximum gradient at a location of the central magnetic pole and at a location of the outer annular pole.

15. The method of claim 11, wherein the accelerating channel provides the magnetic shield to force generation of ions of a working substance at a location of the central magnetic pole and at a location of the outer annular pole.

16. The method of claim 11, wherein the accelerating channel provides the magnetic shield to maximize acceleration of ions of a working substance at a location of the central magnetic pole and at a location of the outer annular pole.

17. The method of claim 11, further comprising:

protecting, by a first isolator, the central magnetic pole; and protecting, by a second isolator, the outer annular pole.

18. The method of claim 17, wherein the accelerating channel provides the magnetic shield to force ions of a working substance to pass the first isolator and the second isolator, thereby decreasing erosion of the first isolator and the second isolator.

19. The method of claim 11, further comprising:

providing, by a xenon storage and feed system, a working substance to the anode-gas distributor and an outer hollow cathode; and providing, by a power processing unit, the electrical current to the coil.

20. An electric propulsion system comprising:

a xenon storage and feed system to provide a working substance to the anode-gas distributor and an outer hollow cathode;

a power processing unit to provide an electrical current to a coil; and an Hall-effect thruster (HET) comprising:

an accelerating channel made of a soft metallic magnetic material to provide a magnetic shield;

a magnetic system including a central magnetic pole, an outer annular pole, a magnetic circuit, and the coil carrying the electrical current, wherein the magnetic system is to generate a radial magnetic field in the accelerating channel ionizing a working substance;

an anode-gas distributor disposed within the accelerating channel; and an outer hollow cathode, the anode-gas distributor and the outer hollow cathode to generate an electrical discharge along the accelerating channel.

* * * * *